US005951248A

United States Patent [19]

Hall

[11] Patent Number: 5,951,248

[45] Date of Patent: Sep. 14, 1999

[54] VERTICAL CONFIGURED PUMP

[75] Inventor: Clarence F. Hall, Claremore, Okla.

[73] Assignee: Baker Hughes Incorporated, Houston, Tex.

[21] Appl. No.: 08/907,553

[22] Filed: Aug. 8, 1997

[51] Int. Cl.[6] ..... F01D 25/28

[52] U.S. Cl. ..... 415/213.1; 415/104; 415/134; 415/199.1; 417/360; 417/423.15; 248/65

[58] Field of Search ..... 415/213.1, 214.1, 415/134, 135, 104, 107, 199.1, 199.2, 199.3; 417/360, 424.1, 423.15; 248/689, 65, 55

[56] References Cited

U.S. PATENT DOCUMENTS

| | | | |
|---|---|---|---|
| 2,738,151 | 3/1956 | Herzog | 248/55 |
| 2,748,714 | 6/1956 | Henry | 415/104 |
| 4,661,047 | 4/1987 | Weis . | |
| 4,978,281 | 12/1990 | Conger, IV . | |
| 5,017,104 | 5/1991 | Baker et al. | 417/424.1 |
| 5,030,346 | 7/1991 | McEwen . | |
| 5,071,317 | 12/1991 | Leach | 415/199.2 |
| 5,222,871 | 6/1993 | Meyer et al. . | |
| 5,262,065 | 11/1993 | Hansen . | |
| 5,332,373 | 7/1994 | Schendel . | |
| 5,489,188 | 2/1996 | Meyer et al. . | |

FOREIGN PATENT DOCUMENTS 0 877 165 A2 11/1998 European Pat. Off. .

*Primary Examiner*—F. Daniel Lopez
*Assistant Examiner*—Richard Woo
*Attorney, Agent, or Firm*—James E. Bradley

[57] ABSTRACT

An apparatus for pumping fluid includes a centrifugal pump which is mounted to a support base. The support base has a support column which extends from the base in an approximately vertical direction. Braces are connected between the pump and the column along the longitudinal axis of the pump to laterally support the pump in the vertical direction. A thrust chamber and an electric motor are coupled to the pump for driving the pump and absorbing downthrust. The braces have slidable members located within them to allow the pump to thermally grow relative to the support column due to elevated temperatures of the fluid being pumped.

20 Claims, 4 Drawing Sheets

VERTICAL CONFIGURED PUMP

TECHNICAL FIELD

This invention relates in general to pumping systems using centrifugal well pumps and in particular to a centrifugal pump for use on an offshore production platform.

BACKGROUND ART

Offshore production platforms for oil and gas frequently have the need for pumps mounted on the platform. The pumps are used generally for transferring oil to gathering facilities and for injecting water into the wells. The most common type of pump used offshore is a positive displacement reciprocating pump.

While positive displacement pumps perform the job intended, large capacity positive displacement pumps are expensive, heavy and take up a large amount of space. Size and weight are particularly problems for offshore floating platforms. Minimizing space and weight on these platforms is very important.

Another type of pump commonly used in oilfield operations is an electrical submersible pump. These pumps are normally employed in a well for pumping fluid up the well to the surface. The pump is centrifugal, being made up of a large number of stages, each stage having an impeller and diffuser. The pump is driven by a downhole electric motor.

Electrical submersible pumps are also used on the surface for injecting water into wells for pressure maintenance and disposal. When used on the surface, the pumps are normally mounted horizontally with a thrust chamber and an electrical motor on one end. Additionally, these surface electrical centrifugal pumps have been mounted on a frame to incline them at an acute angle relative to horizontal.

A centrifugal electrical pump has certain advantages over positive displacement pumps for oilfield use. A centrifugal pump is normally less expensive in initial costs and it may have a lower maintenance cost. However, it is not uncommon for such a pump, even in a surface application, to be more than 30 feet in length. Because of the space required to support the pump horizontally, the length presents a disadvantage when employed offshore. Consequently, the use of centrifugal pumps as horizontally mounted surface pumps has been on land where is the length of the pump is not a disadvantage.

DISCLOSURE OF INVENTION

In this invention, a centrifugal pump is utilized for pumping fluid, particularly for an offshore platform. The centrifugal pump is mounted to a support base in an approximately vertical orientation. A support column extends from the base in the same approximately vertical direction. Braces connect between the pump and the column along the longitudinal axis of the pump to support the pump radially.

The electrical motor for driving the pump is mounted to the base, with a thrust chamber located between the pump and the motor. Preferably the pump inlet is on the base end with the outlet on the opposite end. A discharge pipe extends alongside the pump parallel to it. The discharge pipe is connected to the outlet of the pump and leads back to the base for connection to a flowline.

If the fluids being pumped are elevated in temperature, the pump may increase incrementally in length due to thermal growth. The support column will not increase in length as it will not be exposed to the elevated temperatures. To accommodate the difference in thermal growth, the braces have members which will move relative to each other to allow limited axial movement of the pump. This allows the pump to freely experience thermal growth without increasing stress on any of the braces.

The thrust chamber contains a thrust bearing submerged in lubricant. The drive shaft from the motor extends through the thrust chamber and is coupled to the pump for driving the pump. Leakage around the shaft can be expected. To avoid any leakage that might find its way to the sea, a sump housing is mounted below the thrust chamber. The sump housing has a passage for the shaft as well. It has a sump for collecting any leakage. The sump has a drain leading back to the lubricant reservoir.

BEST MODE FOR CARRYING OUR THE INVENTION

Figure 1:
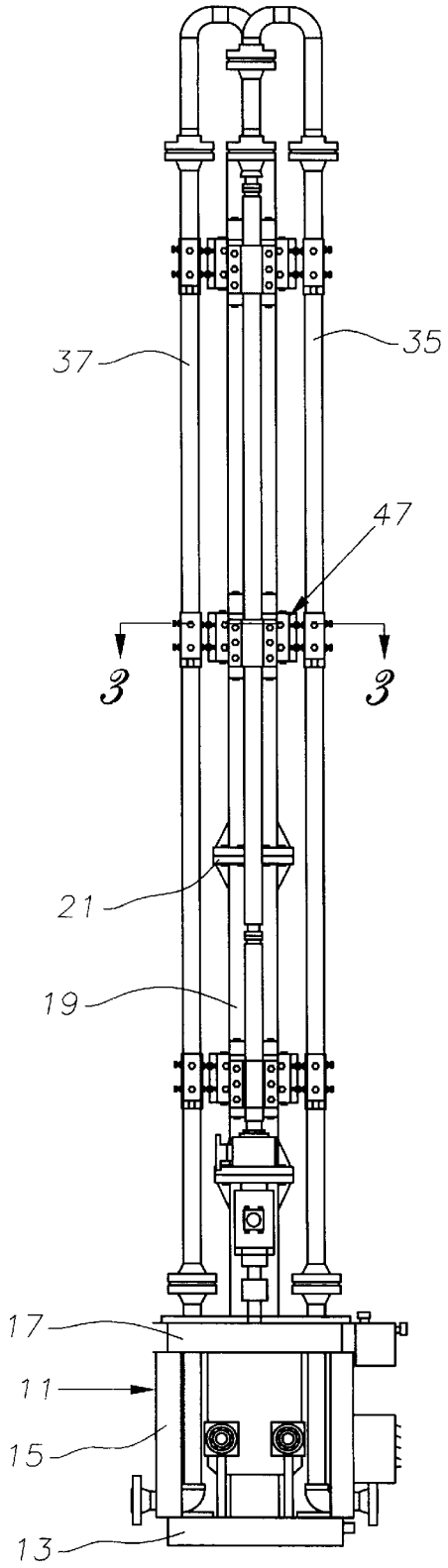
FIG. 1 is a side elevational view of a pump assembly constructed in accordance with this invention.
Figure 2:
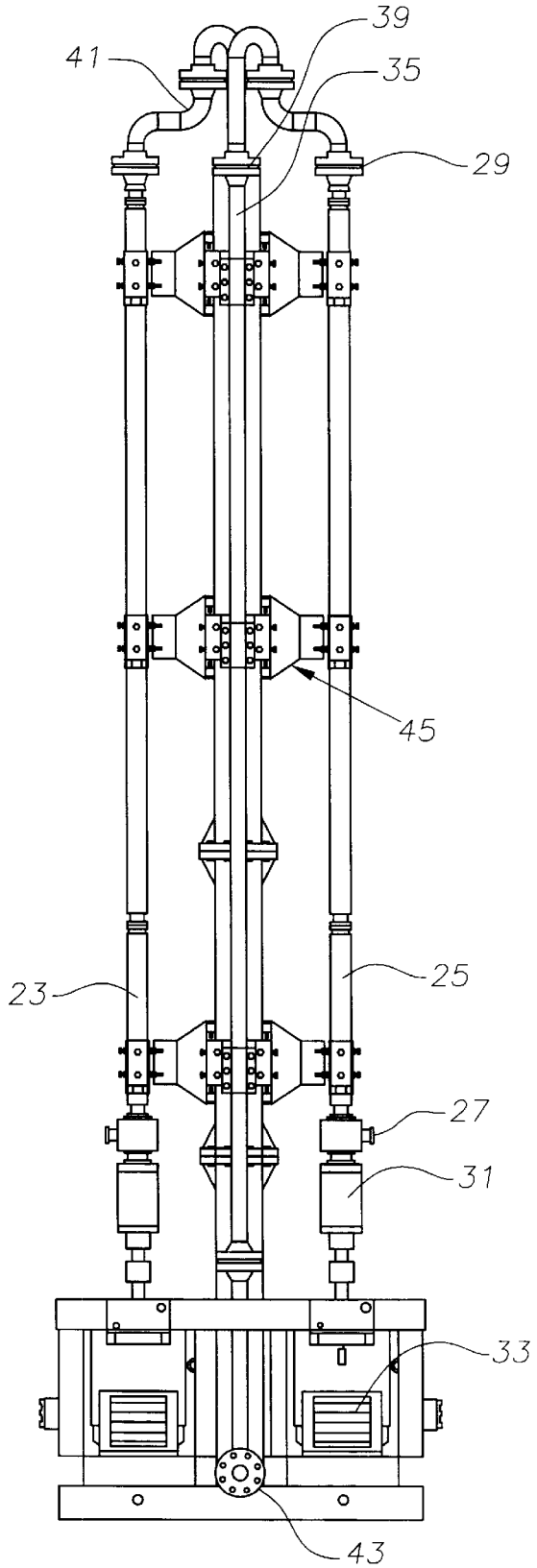
FIG. 2 is another front elevational view of the pump assembly of FIG. 1 as seen from the right side of FIG. 1.

Referring to FIGS. 1 and 2, the pump assembly includes a base 11. Base 11 is a rectangular frame having a lower level 13 which is adapted to be mounted to a support surface, such as a deck or floor of an offshore platform. Four legs 15 extend upward from lower level 13 to an upper level 17. A column 19 is supported by lower and upper levels 13, 17 and extends vertically upward for typically more than 30 feet. Column 19 is a tubular member, preferably rectangular for enhanced resistance to bending. Column 19 may be of multiple sections as shown, joined together by flange connections 21.

In the embodiment shown, column 19 provides radial support for a pair of centrifugal pumps 23, 25. Pumps 23, 25 are of conventional design, each having a large number of stages of impellers and diffusers (not shown). Pumps 23, 25 are of a type that are normally employed in wells for pumping high volumes of fluid to the surface. Each pump 23, 25 has an intake 27 which is preferably on the lower end a short distance above base 11. Each pump has a discharge 29 at the upper end.

A thrust chamber 31 is located below each pump 23, 25 for absorbing downthrust created due to the operation of the pump. Each thrust chamber 31 extends from upper level 17 to the lower end of one of the pumps 23, 25. An electrical motor 33 which may also be referred to as a primer mover is located at the lower end of each thrust chamber 31. Each electrical motor 33 is supported on lower level 13 for driving one of the pumps 23, 25. Base 11 will support all of the weight of pumps 23, 25. A pair of discharge pipe 35, 37 are used to transmit fluid being pumped by pumps 23, 25 back to the vicinity of base 11. Each discharge pipe 35, 37 is a tubular member that extends vertically, parallel to pumps 23, 25 and column 19. Each discharge pipe 35, 37 has an inlet 39 on the upper end that is connected by a conduit 41 to one of the discharges 29. The outlet 43 for each discharge pipe 35, 37 is located near lower level 13 of base 11. The length of each pump 23, 25, including conduit 41, will be considerably longer than either the width or length of base 11. In one example, the length of each pump 23, 25 plus conduit 41 is about 36 feet while the length of base 11 is less than 8 feet and the width a little more than 3 feet. Preferably, the length of base 11 is no more than one-third the length of each pump 23, 25.

Pump braces 45 are used to connect pumps 23, 25 to column 19 for radial support. Pump braces 45 are spaced along the length of column 19. Similarly, pipe braces 47 are used to support discharge pipes 35, 37 with column 19. In the embodiment shown, pipe braces 47 are located at the same vertical positions as pump braces 45.

Figure 3:
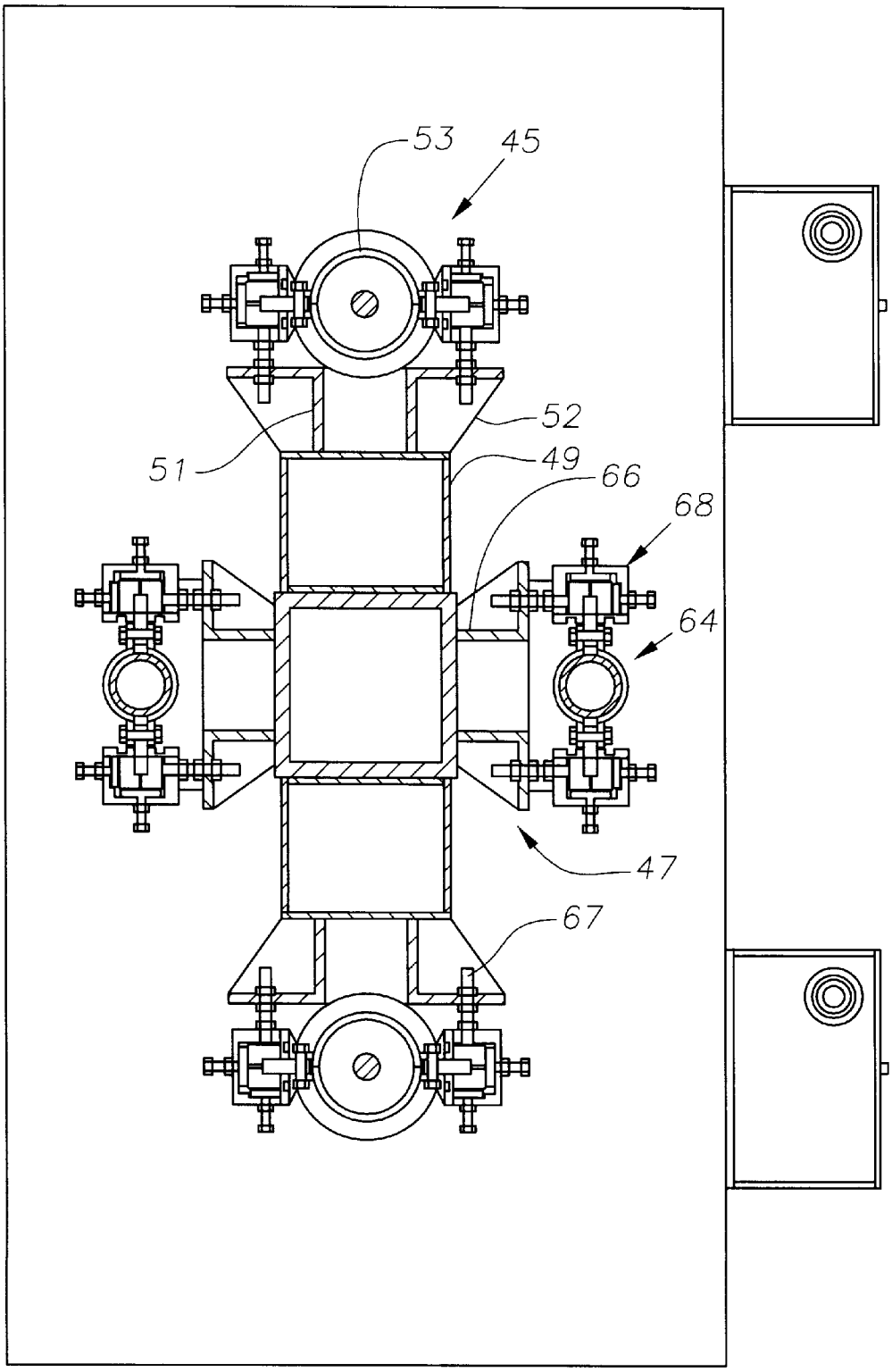
FIG. 3 is a sectional view of the pump assembly of FIG. 1, taken along the line 3—3.

Referring to FIG. 3, each pump brace 45 is an assembly with a bracket assembly stationarily mounted to column 19 and a clamp assembly stationarily mounted to a pump 23, 25. The clamp assembly is capable of limited axial movement relative to the bracket assembly, but not radial movement. The bracket assembly includes an extension member 49 which is bolted to column 19. Extension member 49 is a rectangular tubular member. A bracket 51 is in turn bolted to extension member 49. Brackets 51 are reinforced by gussets 52.

Figure 4:
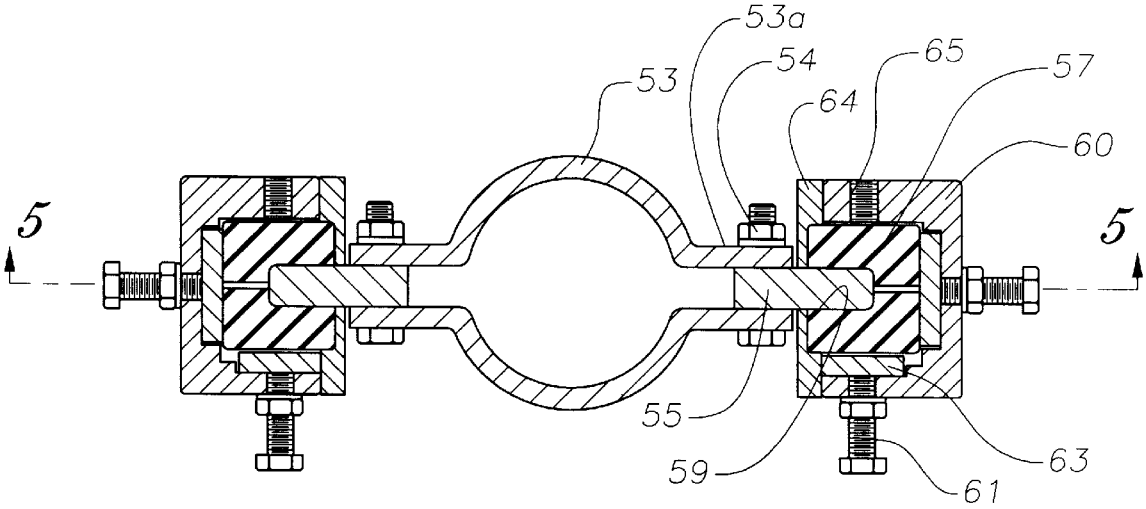
FIG. 4 is an enlarged sectional view of one of the braces of the pump assembly of FIG. 1, taken along the line 4—4 of FIG. 5.

The clamp assembly includes a clamp 53 which is clamped about one of the pumps 23, 25 for movement with the pump. Referring now to FIG. 4, clamp 53 comprises two semi-circular halves which have lateral flanges 53*a* bolted together by bolts 54. A pair of slide members 55 are bolted between the mating flanges 53*a* of clamp 53, one on each side. Each slide member 55 is preferably metal such as stainless steel. Slide member 55 thus moves in unison with clamp 53 and with one of the pumps 23, 25.

Figure 5:
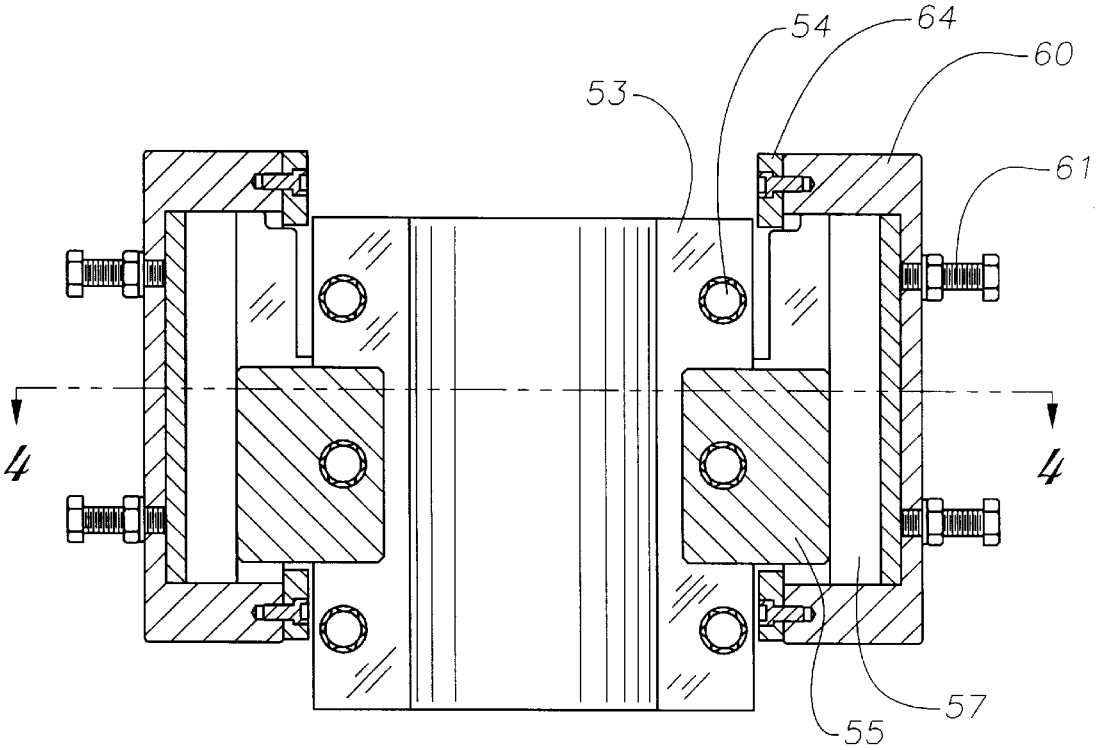
FIG. 5 is a sectional view of the brace of FIG. 4, taken along the line 5—5 of FIG. 4.

The bracket assembly of each brace 45 also includes glands 57, each being stationarily supported by one of the brackets 51. Each gland 57 comprises two halves of a nonmetallic member, such as polypropylene which abut and are configured to define a recess 59 on the inner edges facing clamp 53. Each slide member 55 is sandwiched in one of the recesses 59. As shown in FIG. 5, glands 57 are almost twice the height of each slide member 55. Glands 57 are carried in housings or shoes 60 which are rectangular members that surround glands 57 on three sides, exposing only the inner sides. Bolts 61 bear against compression plates 63 on two of the sides of glands 57 for compressing or deforming glands 57. Tightening bolts 61 causes glands 57 to grip slide member 55 more tightly to adjust the amount of friction desired. As shown in FIG. 5, retainer plates 64 are located on the upper and lower sides for retaining glands 57 within shoes 60. Bolt holes 65, shown in FIG. 4, receive bolts 67, shown in FIG. 3, for rigidly securing shoes 60 to brackets 51. Shoes 60, bolts 67, brackets 51, and extension members 49 prevent any radial movement of pumps 23, 25 relative to the longitudinal axis of column 19.

Pipe braces 47, shown in FIG. 3, are constructed in the same manner as pump braces 45, each having a bracket assembly and a clamp assembly which can move longitudinally relative to the bracket assembly. Pipe braces 47 include a bracket 66 mounted directly to column 19 by bolts. A clamp assembly 68, constructed as shown in FIGS. 4 and 5, clamps to the pipes 35, 37 and is mounted to bracket 66.

Figure 6:
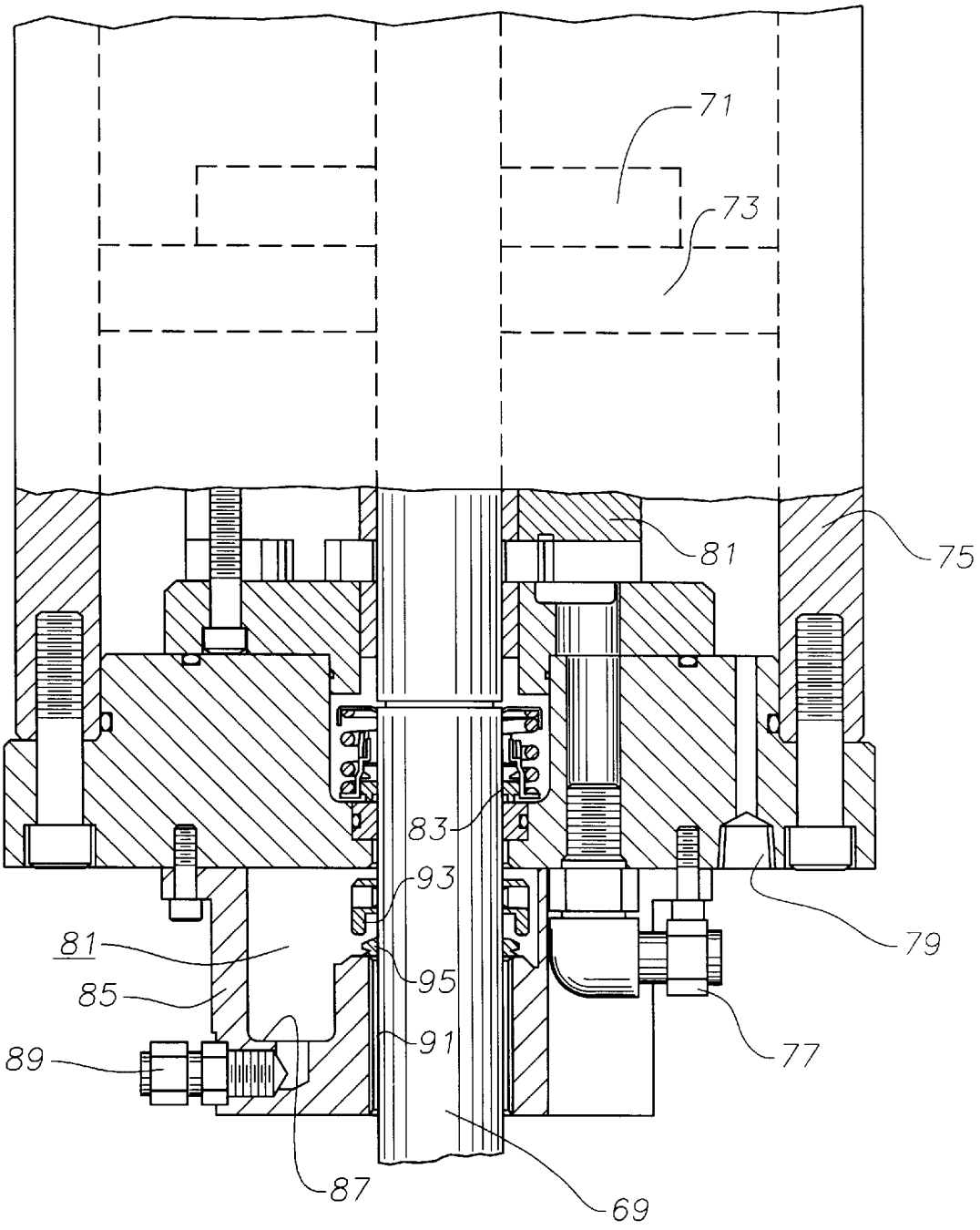
FIG. 6 is an enlarged view, partially in section, of a lower portion of the thrust chamber of the pump assembly of FIG. 1.

Referring to FIG. 6, a shaft 69, made up of multiple shaft sections, extends from each electric motor 33 (FIG. 2) to one of the pumps 23, 25. Shaft 69 is rotated by one of the motors 33 to drive one of the pumps 23, 25. Downthrust is created by the pumping action, the downthrust being applied to shaft 69. Thrust is absorbed by a thrust bearing in thrust chamber 31. The thrust bearing is conventional, having a runner 71, shown schematically by dotted lines, which rotates with shaft 69 and engages a stationary thrust bearing pad 73 to transfer the downthrust to thrust chamber housing 75.

Housing 75 is filled with lubricant which is supplied through an inlet 77. The lubricant is circulated and returns out outlet 79 to a reservoir (not shown). In the embodiment shown, a gear pump 81 pumps the lubricant through housing 75 past thrust bearing 71, 73. A face seal 83 has a rotating component mounted to shaft 69 and a stationary component to an end wall of housing 75. Face seal 83 is conventional and spring biased for sealing lubricant within housing 75.

Face seals 83 are known to leak a slight amount over time. To avoid any of the oil leaking into the sea, a sump housing 85 is bolted to the lower end of thrust chamber housing 75. Sump housing 85 has a sump 87 which surrounds shaft 69 for collecting any leakage through seal 83. A drain 89 will lead back to the same reservoir (not shown) which supplies lubricant for circulation through inlet 77 and outlet 79. Sump housing 85 has a passage 91 through which shaft 69 passes. A slinger 93 is mounted to shaft 69 above and partially surrounds a seal 95. Slinger 93 is an annular member which serves to prevent lubricant from flowing directly down shaft 69 into contact with seal 95. Slinger 93 tends to force leaking lubricant radially outward from shaft 69 where it will flow down into the lower portion of sump 87.

In operation, the pump assemblies described herein are particularly are meant to be utilized on an offshore platform where space is a premium. Base 11 will be mounted to a deck or floor surface of the platform. Column 19 extends from base 11 in an approximate vertical direction, normally upward. If necessary to avoid other structures on the platform, column 19 may lean so long as it is properly sized or braced to support pumps 23, 25. The term "approximately vertical" refers to angles up to about 45 degrees from vertical, but even in these instances, base 11 will maintain its small length and width. Pumps 23, 25 are mounted parallel to column 19 and connected by braces 45, shown in FIG. 2. Discharge pipes 35, 37 are connected to the pump outlets via conduits 41. Discharge pipes 35, 37 will be supported by braces 47 which are also secured to column 19.

Fluid is supplied to the inlets 27 of pumps 23, 25. The pressure is increased, with the fluid discharging out the discharge pipe outlets 43. If the fluid is at an elevated temperature, which is common, the expansion of the metal members of pumps 23, 25 causes them to thermally grow or lengthen. Similarly, pipes 35, 37 will thermally grow or lengthen. On the other hand, column 19 will be at a lower temperature and thus will not thermally grow. Referring to FIGS. 4 and 5, clamp 53 will move upward during thermal growth with its pump 23 or 25. Slide member 55 also moves upward with clamp member 53, sliding within gland 57. The greater length of shoes 60 over slide members 55 will accommodate any expected thermal expansion. When pumps 23, 25 are turned off, they will cool and shrink back to the original dimension. When this occurs, slide members 55 slide downward in glands 57.

For maintenance, it may be necessary to remove the thrust chamber 31. Braces 45 allow this to be performed without detaching pumps 23, 25 from clamps 53 (FIGS. 4, 5). By loosening bolts 61, pump 23 or 25 can be lifted a short distance until slide members 55 contacts retainer plates 64 at the upper end of shoes 60. This provides adequate clearance to remove thrust chamber 31 (FIG. 2). After re-installation of thrust chamber 31, glands 57 can be tightened to increase the friction against slide members 55 by tightening bolts 61.

During operation, downthrust will be transferred to the thrust bearing 71, 73 of thrust chamber 31, as shown in FIG. 6. Lubricant is circulated through thrust chamber housing 75 for lubricating thrust bearing 71, 73. Seal 83 contains the lubricant within housing 75. Any leakage that may be occurring past seal 83 will be collected in sump 87 and returned to the common reservoir.

The invention has significant advantages. A centrifugal pump usually has less initial cost and less weight than a positive displacement pump for the same task. Mounting the centrifugal pump in a vertical orientation reduces the amount of deck or floor space to a smaller amount than that required of a positive displacement pump.

While the invention has been shown in only one of its forms, it should be apparent to those skilled in the art that it is not so limited, but is susceptible to various changes without departing from the scope of the invention. For example, rather then two pumps, a single pump may be supported by a support column. The support column may be a framework surrounding the pump. Moreover, the base could be mounted to an upper structure, with the column and pump extending downward.

I claim:

1. An apparatus for pumping fluid, comprising:

a multistage pump having length along a longitudinal axis;

a support base which has a floor adapted to mount to a support surface;

a support column which extends upward from the base in an approximately vertical direction offset from said multi-stage pump;

a brace which is connected between the pump and the column for supporting the pump with its longitudinal axis in said approximately vertical direction and limiting radial movement of the pump relative to the support column; and a prime mover coupled to the pump for driving the pump, the prime mover being mounted to the floor of the support base below the pump.

2. The apparatus according to claim 1, wherein the base further comprises an upper level supported above the floor of the base by a plurality of legs; and wherein the pump is supported on the upper level of the base during operation and the prime mover is located below the upper level of the base.

3. The apparatus according to claim 1, wherein the brace is a rigid member with one end mounted to the support column and an opposite end mounted to the pump, and wherein one of the ends of the brace permits longitudinal movement of the pump relative to the support column to accommodate thermal growth due to production fluid flowing through the pump.

4. The apparatus according to claim 1, wherein:

the pump has an inlet on a first end and an outlet on a second end; wherein the apparatus further comprises:

a discharge pipe extending substantially parallel to the longitudinal axis of the pump from the outlet toward the first end; and wherein the discharge pipe is radially supported by the support column.

5. The apparatus according to claim 1, wherein the brace comprises:

a first member stationarily connected to the pump;

a second member stationarily connected to the column; and the first and second members being movably connected to each other to allow limited axial movement relative to one another but prevent radial movement relative to one another.

6. The apparatus according to claim 1, wherein the support base has a height measured along the longitudinal axis; and the height of the base is substantially shorter than the length of the pump.

7. An apparatus for pumping fluid, comprising:

at least one multistage pump having a length extending along a longitudinal axis, a first port on a first end, a second port on a second end, and a shaft extending through the pump along the axis for driving the pump;

a prime mover coupled to the shaft for driving the pump;

a support base which is adapted to mount on a support surface, the prime mover being mounted to the base;

a support column which extends substantially vertically from the base for substantially the length of the pump;

a pump brace which is connected between the pump and the column for providing radial support for the pump, the brace supporting the pump with its longitudinal axis substantially parallel with the column and with the second end of the pump spaced away from the base; and wherein the brace comprises:

a first member stationarily connected to the pump;

a second member stationarily connected to the column; and the first and second members being movably connected to each other to allow limited axial movement relative to one another to accommodate thermal growth of the pump, but prevent radial movement relative to one another.

8. The apparatus according to claim 7, wherein the prime mover is mounted below the pump.

9. The apparatus according to claim 7, further comprising a thrust chamber mounted to the support base at the first end of the pump for transferring to the support base the weight of the pump and downthrust on the shaft created by operation of the pump; and wherein the brace may be adjusted to temporarily transfer all of the weight of the pump to the support column, enabling the thrust chamber to be removed from the base for maintenance without removing the pump.

10. The apparatus according to claim 7, wherein the support base has a floor and an upper level supported above the support base by legs extending between the upper level and the support base; and wherein the apparatus further comprises:

a thrust chamber mounted to the upper level of the support base at the first end of the pump for transferring to the upper level of the support base downthrust on the shaft created by operation of the pump; and wherein the thrust chamber comprises:

a thrust bearing having a rotatable member mounted to the shaft for rotation therewith and a stationary member mounted in the thrust chamber; and a seal at the lower end of the thrust chamber which seals around the shaft to seal fluids within the thrust chamber.

11. The apparatus according to claim 7, wherein said at least one multistage pump comprises an additional multistage pump located alongside and parallel to said first mentioned pump, said additional multistage pump also being supported by the column.

12. The apparatus according to claim 7, wherein the first member comprises:

a clamp which clamps around the pump; and a slide member which is secured to the clamp and extends laterally outward therefrom; and wherein the second member comprises:

a gland which slidably receives the slide member, the gland being carried within a shoe stationarily carried by the column.

13. The apparatus according to claim 7, further comprising a thrust chamber mounted to the support base at the first end of the pump for transferring to the support base the downthrust on the shaft created by operation of the pump; wherein the thrust chamber comprises:

a housing having a lower end through which the shaft extends;

a thrust bearing having a rotatable member mounted to the shaft for rotation therewith and a stationary member mounted in the housing, the housing being filled with lubricant to lubricate the thrust bearing;

a seal at the lower end of the housing which seals around the shaft to seal the lubricant within the housing; and a sump mounted to the housing below the seal for collecting any leakage of lubricant that may occur past the seal, the shaft extending sealingly through the sump to the motor.

14. The apparatus according to claim 7, wherein the support base has a height measured along the longitudinal axis; and the height of the base is substantially shorter than the length of the pump.

15. An apparatus for pumping fluid, comprising:

a pair of multistage pumps, each of the pumps having a length extending along a longitudinal axis, an inlet port on a first end and an outlet port on a second end;

a pair of prime movers located below the pumps and coupled to the pumps for driving the pumps;

a support base which is adapted to mount on a support floor, the prime movers being mounted on the base;

a support column which extends upward from the base for substantially the lengths of the pumps;

a pair of pump clamp assemblies, each of which is stationarily clamped to one of the pumps; and a pair of pump bracket assemblies which are stationarily connected to the column in alignment with the pump clamps, the pump bracket assemblies being connected to the pump clamps for limited axial movement relative to each other to accommodate thermal growth of the pumps but preventing radial movement relative to each other, the pump clamp and pump bracket assemblies supporting the pumps with their longitudinal axes parallel to the column.

16. The apparatus according to claim 15, (wherein said at least one centrifugal pump comprises an additional centrifugal pump located alongside and parallel to said first mentioned pump, said additional centrifugal pump being supported by the column) further comprising a thrust chamber mounted to the support base at the first end of each of the pumps for transferring to the support base weight of the pumps and downthrust created by operation of the pumps; and wherein the bracket assemblies and clamp assemblies may be adjusted to transfer all of the weight of the pumps to the support column, enabling the thrust chambers to be removed from the base for maintenance without removing the pumps.

17. The apparatus according to claim 15, further comprising a thrust chamber mounted to the support base at the first end of each of the pumps for transferring to the base downthrust on the shaft created by operation of the pump; and wherein each of the thrust chambers comprises:

a housing having upper and lower ends through which a drive shaft extends;

a thrust bearing having a rotatable member mounted to the shaft for rotation therewith and a stationary member mounted in the housing, the housing being filled with lubricant to lubricate the thrust bearing;

a seal at the lower end of the housing which seals around the shaft to seal the lubricant within the housing; and a sump mounted to the housing below the seal for collecting any leakage of lubricant that may occur past the seal, the shaft extending through the sump to one of the prime movers.

18. The apparatus according to claim 15 wherein each of the pump clamp assemblies comprises:

a clamp encircling and rigidly mounted to one of the pumps;

a slide member rigidly mounted to and extending laterally from the clamp; and each of the pump bracket assemblies comprises:

a bracket rigidly mounted to and extending laterally outward from the column; and a nonmetallic gland stationarily carried by the bracket and having a slot which slidably receives the slide member, the gland having a length greater than a height of the slide member to allow limited axial movement of the slide member relative to the gland.

19. The apparatus according to claim 15, wherein the support base has a height measured in a longitudinal direction; and the height of the base is substantially shorter than the lengths of the pumps.

20. The apparatus according to claim 19, wherein the length of the base is less than one-third the lengths of the pumps.

* * * * *

UNITED STATES PATENT AND TRADEMARK OFFICE

CERTIFICATE OF CORRECTION

PATENT NO. : 5,951,248

DATED : September 14, 1999

INVENTOR(S) : Clarence F. Hall

It is certified that error appears in the above-identified patent and that said Letters Patent is hereby corrected as shown below:

Column 8, Line 1 through Line 5, delete "(wherein said at least one centrifugal pump comprises an additional centrifugal pump located alongside and parallel to said first mentioned pump, said additional centrifugal pump being supported by the column)".

Signed and Sealed this

Second Day of May, 2000

*Attest:*

*Attesting Officer*

Q. TODD DICKINSON

*Director of Patents and Trademarks*